US006088902A

United States Patent [19]

Summers

[11] Patent Number: 6,088,902

[45] Date of Patent: Jul. 18, 2000

[54] METHOD OF FIXING A TUBULAR METAL MEMBER IN AN APERTURE AND TOOL THEREFOR

[76] Inventor: Dennis Arthur Summers, Top-Security Fencing (MI) Limited, 80 New Road, Silverbridge Newry, County Down BT35 9LM, United Kingdom

[21] Appl. No.: 08/750,922

[22] PCT Filed: Jun. 19, 1995

[86] PCT No.: PCT/GB95/01430

§ 371 Date: Jan. 22, 1997

§ 102(e) Date: Jan. 22, 1997

[87] PCT Pub. No.: WO96/03233

PCT Pub. Date: Feb. 8, 1996

[30] Foreign Application Priority Data

Jul. 22, 1994 [GB] United Kingdom ..... 9414849

[51] Int. Cl.[7] ..... B21D 26/00

[52] U.S. Cl. ..... 29/523; 72/58; 72/466.8

[58] Field of Search ..... 411/32, 33, 34; 72/54, 57, 58, 466.8; 29/523, 58, 61

[56] References Cited

U.S. PATENT DOCUMENTS

| | | | |
|---|---|---|---|
| 1,365,719 | 1/1921 | Ogden | 411/34 |
| 2,535,403 | 12/1950 | Froggatt | 72/58 |
| 3,071,399 | 1/1963 | Cronin | 29/523 |
| 3,152,630 | 10/1964 | Nilsson | 72/58 |
| 4,387,507 | 6/1983 | Kelly | 72/58 |
| 4,418,457 | 12/1983 | Müller . | |
| 4,508,321 | 4/1985 | Morimoto | 29/523 |
| 4,698,896 | 10/1987 | Osterwald et al. | 29/523 |
| 4,779,333 | 10/1988 | Rabe et al. | 72/58 |
| 4,789,285 | 12/1988 | Fischer | 411/32 |
| 5,158,389 | 10/1992 | Osterwald et al. | 29/523 |
| 5,224,256 | 7/1993 | Haglund | 29/523 |
| 5,725,341 | 3/1998 | Hofmeister | 411/34 |

FOREIGN PATENT DOCUMENTS

| | | |
|---|---|---|
| 84761 | 6/1992 | Australia . |
| 2651815 | 3/1991 | France . |
| 2699617 | 6/1994 | France . |
| 93 09892 | 5/1993 | WIPO . |

*Primary Examiner*—David Jones
*Attorney, Agent, or Firm*—Lane, Aitken & McCann, L.L.P.

[57] ABSTRACT

A method of fixing a tubular metal member in an aperture which comprises, locating the tubular metal member in the aperture and deforming the 10 metal of the tubular member to expand to extend within the confines of said aperture, which may be formed in masonry. A method of fixing two tubular metal members one to the other, is disclosed, which comprises locating a first tubular metal member (10) through a transverse aperture (12) in a second tubular metal member (11) and deforming the metal of the first member (10) to expand (13) to extend within the longitudinal passage of the second member (11) at the location of the transverse aperture (12) therethrough. A tool for carrying out the method is also disclosed.

8 Claims, 4 Drawing Sheets

METHOD OF FIXING A TUBULAR METAL MEMBER IN AN APERTURE AND TOOL THEREFOR

The invention relates to metal fixing and more particularly to a method of fixing a tubular metal member within an aperture, for example masonry or a transverse aperture through a second tubular metal member, for example, to produce fencing.

It is an object of the invention to provide a simple and inexpensive masonry fixing device and method.

It is a further object of the invention to provide a method of fixing two tubular metal members together without the need for welding, brazing, soldering or the like.

According to one aspect of the invention there is provided a method of fixing a tubular metal member in an aperture which comprises, locating the tubular metal member in the aperture and deforming the metal of the tubular member to expand to extend within the confines of said aperture.

The aperture may be formed in masonry and the tubular member may be formed internally or externally with a screw-threaded portion to receive a bolt or nut, respectively, in use.

Said internally screw-threaded portion may comprise a nut securely located, for example by crimping, at or adjacent the inner end thereof prior to insertion into the aperture.

The outer end of the tubular member may be formed into an external flange prior to insertion in the aperture.

According to a further aspect of the invention there is provided a method of fixing two tubular metal members, one to the other which comprises locating a first tubular metal member through a transverse aperture in a second tubular metal member and deforming the metal of the first member to expand to extend within the longitudinal passage of the second member at the location of the transverse aperture therethrough.

The first member may have a square cross-section and the second member have a rectangular cross-section, the faces of first member located within the transverse aperture through the second member being deformed in bulbous fashion. A plurality of first members may be fixed to span between a pair of second members to provide a fence section.

According to yet a further aspect of the invention there is provided a tool, for performing the method of fixing as defined in the next preceding two paragraphs, comprising a longitudinally extending member locatable in the first tubular member to extend to said transverse aperture through the second member, an actuator rod slidably located in the longitudinally extending member with an actuator member located at the inner end thereof and attached to actuator means at the outer end thereof and a section of plastically deformable material located around the actuator rod between the inner end of the longitudinally extending member and the actuator member whereby when the actuator rod is drawn towards the actuator means, in use, the actuator member causes deformation of the plastically deformable material to cause deformation of the first tubular member.

Preferably the actuator means comprise an hydraulically actuable ram. Alternatively the outer end of the actuator rod may be screw-threaded to receive an actuator nut, rotation of which would retract the actuator rod in the longitudinally extending member.

The plastically deformable material may comprise a synthetic plastics material such as polyurethane.

The longitudinally extending member may have an adjustable end stop member slidably located exteriorly thereof and locable in desired locations for determining the length of penetration of the longitudinal member within said first tubular member, in use.

According to a still further aspect of the invention there is provided a masonry fixing device for location and fixing in masonry, comprising a tubular metal member with a nut rigidly located interiorly at or adjacent one end thereof.

The nut may be located by a crimped portion of the tubular member adjacent said one end and the other end may be formed with an external flange at the other end thereof.

The foregoing and further features of the invention may be more readily understood from the following description of some preferred embodiments thereof, by way of example, with reference to the accompanying drawings, in which.

Figure 1:
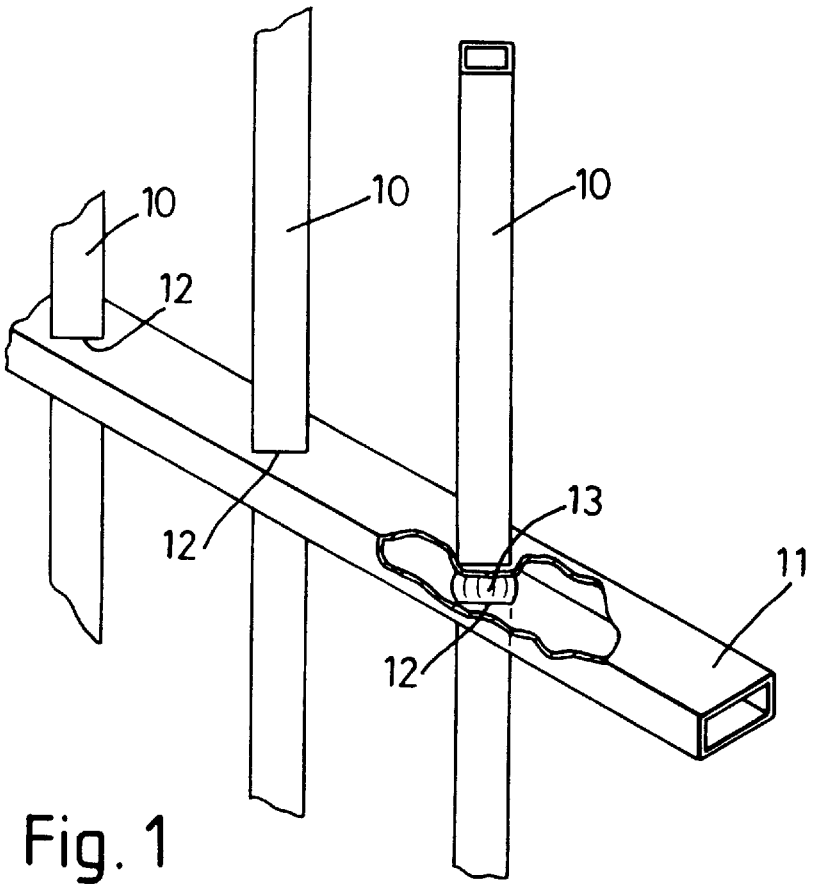
FIG. 1 is a perspective view, part cut away, of a portion of a fence.
Figure 2:
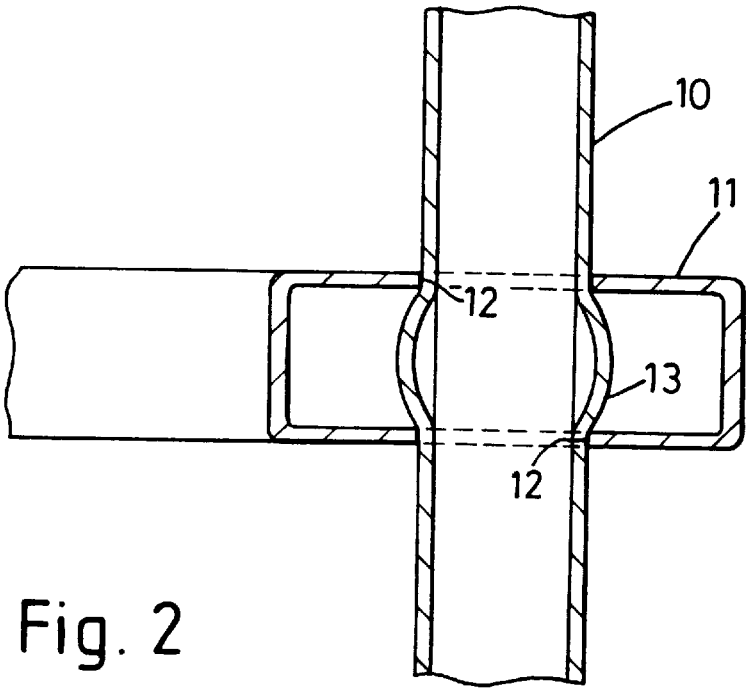
FIG. 2 is an end sectional view, on enlarged scale, of a portion of the fence of FIG. 1.

Referring now to FIGS. 1 and 2 of the drawings there is shown a portion of a fence comprising a plurality of vertical, square cross-section, first tubular metal members 10 located through and fixed to a horizontal, rectangular cross-section, second tubular metal member 11. The member 11 has transverse apertures 12 formed there through and the first members 10 are deformed to provided bulbous protrusions 13 at the location where they pass through apertures 12 in member 11.

Figure 3:
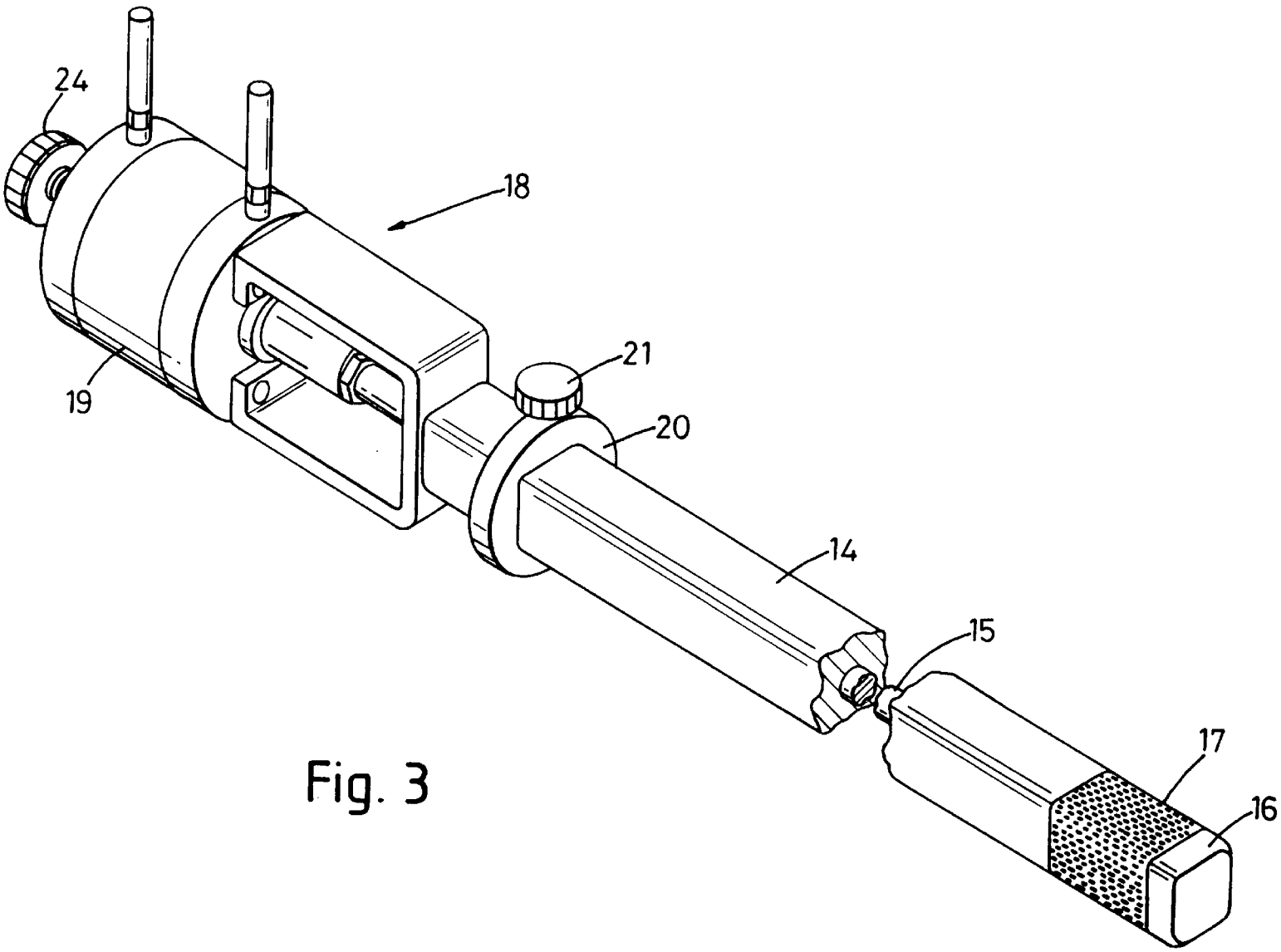
FIG. 3 is a perspective view of a tool for fixing the members of the fence of FIG. 1.

Referring now to FIG. 3 there is shown a tool suitable for deforming the members 10 to produce the protrusions 13. The tool comprises a longitudinally extending member 14 within which is a slidably mounted actuator rod 15. An actuator member 16 is attached to the inner (in use) end of the actuator rod 15 and a member 17 of resiliently deformable material, such as polyurethane, interposed between the inner (in use) end of member 14 and actuator member 16, surrounding actuator rod 15.

The outer end of member 14 is attached to actuator means 18 which includes an hydraulically actuable ram 19. A stop member 20 is slidably located on member 14 and lockable in any required locations there along by knurled manually rotatable locking screw 21.

Figure 4:
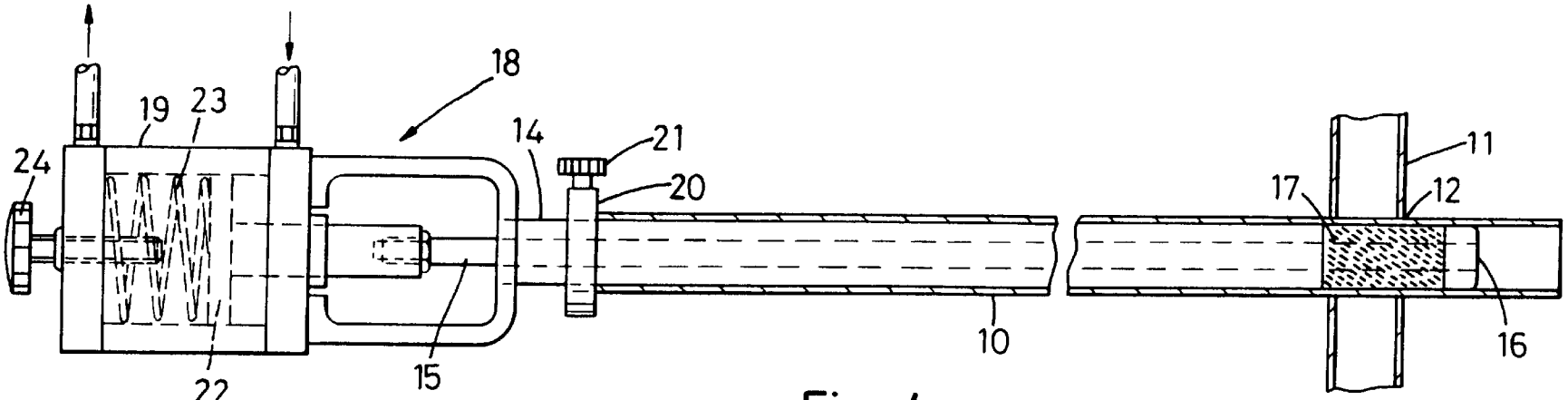
FIG. 4 is a diagrammatic side sectional view of the tool of FIG. 3 located in a fencing member prior to performing fixing.

Referring now to FIGS. 4 and S there is shown the method of operation of the tool of FIG. 3 to produce the fixing of members 10 and 11 of FIGS. 1 and 2.

The member 14 is inserted in member 10 to the extent determined by stop 20 so as to locate member 17 adjacent the aperture 12 in member 11 as shown in FIG. 4.

Figure 5:
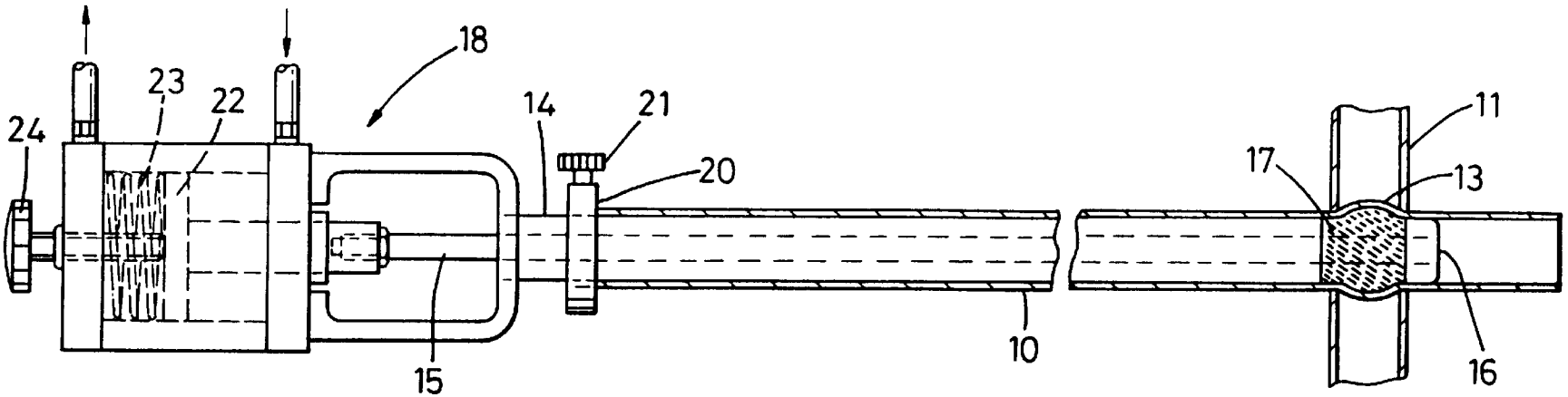
FIG. 5 is similar view to FIG. 4 showing the tool during a fixing operation.

The hydraulic ram 19 is then actuated to move its piston 22 to the left position shown in FIG. 5 against a return spring 23 to abut an adjustable stroke stop 24. Such movement of piston 22 causes rod 15 to retract actuator member 16 towards the inner end of the member 14 thus compressing member 17 to exert pressure on the side walls of member 10 and produce the bulbous deformations 13 of member 10 to protrude within the through passage of member 11 and rigidly fix member 10 to member 11 at this point.

The ram 19 is then de-activated to allow piston 22 to return to the FIG. 4 position under the action of return spring 23 and to allow member 17 to its normal position. The member 14 can then be removed from member 10 to be reused.

Although the members 10 and 11 have been shown as having square and rectangular cross-sections respectively, these could be of other cross-sections, such as circular or octagonal, providing the cross-section of member 11 is greater than that of member 10. Although the method of fixing has been described with particular regard to producing fencing, such method can be used in any environment where two tubular members are to be fixed in a transverse configuration.

With this method of fixing members 11 can be pre-punched with the through apertures, members 10 and 11 galvanised and plastic coated in a factory and then transported to a site for assembly utilising the method of the invention.

Figure 6:
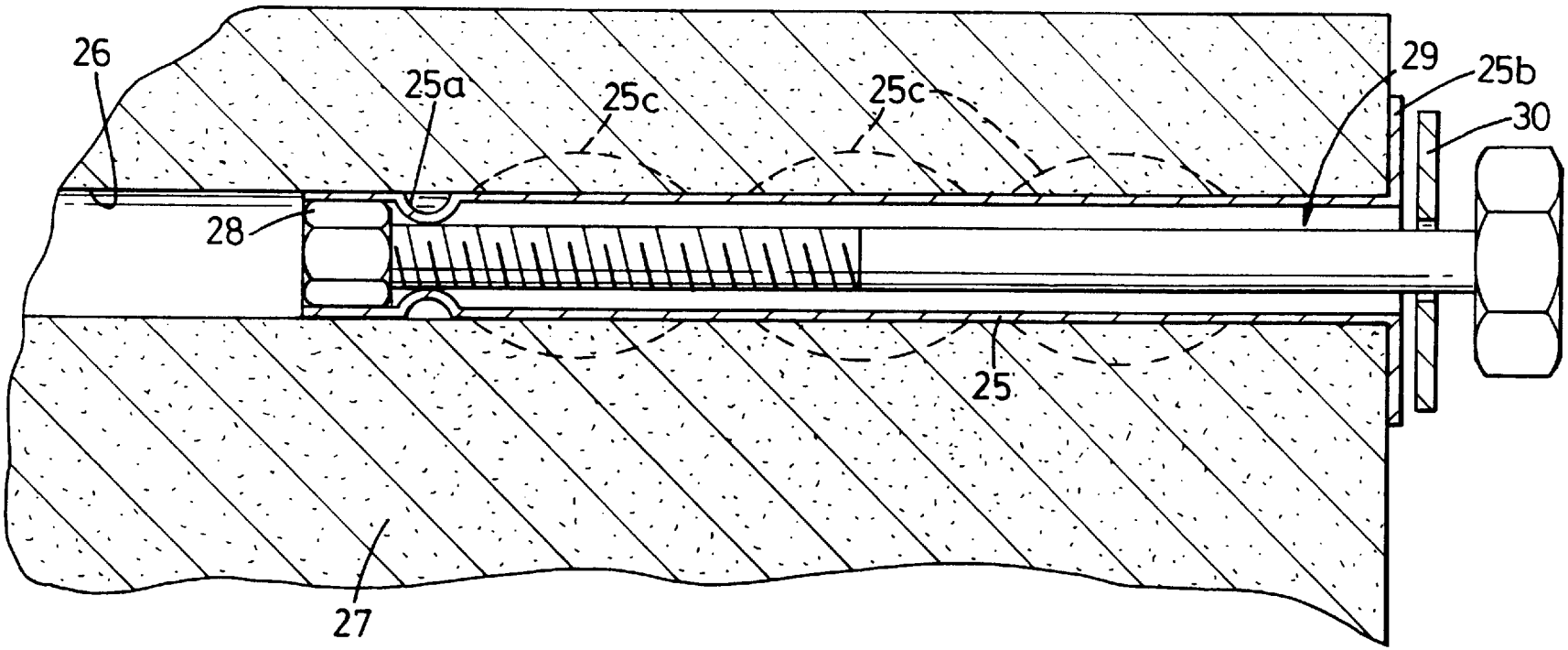
FIG. 6 is a schematic side sectional view of a masonry fixing device.

Referring now to FIG. 6 of the drawings there is shown a masonry fixing device comprising a tubular member 25 located within an aperture 26 in a masonry wall 27. An internally screw-threaded nut 28 is firmly located in the inner end of member 25 for example by crimping as depicted at portion 25*a* of member 25. Alternatively the nut 28 could be welded or otherwise located in the inner end of member 25. The outer end of member 25 is formed with a flange 25*b* to restrict entry of member 25 into aperture 26.

In use the member 25 is located in aperture 26 as shown and a tool, for example as shown in FIGS. 4 or 5 and 6 located therein and actuated to produce a bulbous part-toroidal protrusion 25*c* at any required location along member 25 to lock member 25 firmly within aperture 26. A bolt 29 is then screwed into nut 28 to retain any required object (not shown) to the outer surface of wall 27 with the interposition of a washer 30 if required.

The nut 28 could be replaced by internally screw-threading the member 25 or by replacing or extending flange 25*b* with an externally screw-threaded portion (not shown).

What is claimed is:

1. A method of fixing two tubular members (10, 11) one to the other by locating a first, uncorrugated tubular metal member (10) through opposed, spaced transverse apertures (12) in a second tubular metal member (11) defining a longitudinal passage such that the metal of a portion of the first, uncorrugated tubular metal member is in the longitudinal passage of the second tubular metal member, characterized by placing a resiliently deformable member in the first, uncorrugated tubular metal member; and deforming the metal of the first, uncorrugated tubular member (10) in bulbous fashion (13) by expanding the resiliently deformable member (17) to extend the metal of said portion of the first, uncorrugated tubular member within the longitudinal passage of the second tubular metal member (11) such that the extended metal spans the space between the opposed transverse apertures and abuts the second tubular member at the opposed transverse apertures (12).

2. A method as claimed in claim 1, characterized in that the first uncorrugated tubular metal member (10) has a square cross-section and faces located between the opposed transverse apertures through the second member, and the second tubular metal member (11) has a non-square rectangular cross-section, the faces of the first member (10) located between the opposed transverse apertures (12) through the second member being deformed in said bulbous fashion (13).

3. A method as claimed in claim 2, characterized in that a plurality of first, uncorrugated tubular metal members (10) are fixed to span between a pair of second tubular metal members (11) to provide a fence section, the first tubular metal members having portions extending perpendicular to at least one of the second tubular metal members beyond opposite sides of said one second tubular metal member.

4. A method as claimed in claim 1, wherein the step of placing comprises positioning the resiliently deformable member between the opposed transverse apertures.

5. A method as claimed in claim 1, wherein the resiliently deformable member is expanded by compressing the resiliently deformable member in a direction generally transverse to the direction in which the deformed metal of the first uncorrugated tubular member extends.

6. A method as claimed in claim 1, characterized in that a plurality of first, uncorrugated tubular metal members (10) are fixed to span between a pair of second tubular member members (11) to provide a fence section, the first tubular metal members having portions extending perpendicular to at least one of the second tubular metal members beyond opposite sides of said one second tubular metal member.

7. A fence section comprising:

a plurality of first, uncorrugated hollow members; and a plurality of second hollow members having opposite sides and sets of spaced opposed transverse apertures, a respective one of said transverse apertures of each set being defined in each of said opposite sides, said second hollow members being perpendicular to the first, uncorrugated hollow members, and said first, uncorrugated hollow members passing through the opposed transverse apertures in the second hollow members, wherein each first, uncorrugated hollow member is attached to each said second hollow member by a bulbous expansion of the first hollow member spanning the space between the opposed transverse apertures of a set and by abutment of the bulbous expansion with the second hollow member at the opposed transverse apertures of a set, wherein the bulbous expansion and the abutment age formed by the process of deforming each first, uncorrugated hollow member by placing a resiliently deformable member in the first, uncorrugated tubular member and expanding the resiliently deformable member, and wherein each first, uncorrugated hollow member has portions extending perpendicular to at least one of the second hollow members beyond the opposite sides of said one second hollow member.

8. A method of fixing an object to masonry, comprising locating a tubular metal member in an aperture in the masonry, the tubular metal member having a nut fixed therein;

placing a resiliently deformable member in the tubular metal member, in the aperture;

deforming the metal of the tubular member in bulbous fashion by expanding the resiliently deformable member to extend the metal of the tubular member in the aperture into firm engagement with the masonry; and fixing the object to the tubular metal member by inserting a bolt into the tubular metal member and into engagement with the nut, and tightening the bolt.

* * * * *